United States Patent [19]

Erikson et al.

[11] 4,021,155

[45] May 3, 1977

[54] OIL BURNER PUMPING SYSTEM WITH AIR PURGING VALVE

[75] Inventors: Robert W. Erikson; Frank L. Harwath, both of Rockford, Ill.

[73] Assignee: Sundstrand Corporation, Rockford, Ill.

[22] Filed: Nov. 13, 1975

[21] Appl. No.: 631,578

[52] U.S. Cl. ..... 417/302; 417/435; 417/502

[51] Int. Cl.[2] ..... F04B 49/00; F04B 21/00

[58] Field of Search ..... 417/435, 299, 440, 301, 417/302, 502

[56] References Cited

UNITED STATES PATENTS

| | | | |
|---|---|---|---|
| 2,442,361 | 6/1948 | Holman | 417/299 |
| 2,978,149 | 4/1961 | Rosen | 417/440 |
| 3,216,360 | 11/1965 | Wilson et al. | 417/301 |
| 3,392,674 | 7/1968 | Schlosser | 417/440 |
| 3,446,232 | 5/1969 | Erikson | 417/302 |

*Primary Examiner*—William L. Freeh

*Attorney, Agent, or Firm*—Ted E. Killingsworth; Michael B. McMurry; William R. Peoples

[57] ABSTRACT

A fuel burner pumping system includes a pump having an inlet communicating with a fuel source and an outlet which communicates with a control valve assembly for regulating the pressure of the fuel supplied to the fuel burner nozzle or nozzles through a nozzle passage leading from an outlet port of a main chamber in the control valve assembly. High pressure fuel is pumped into the main chamber through a first outlet passage leading from the pump. A second outlet passage leading from the pump to the nozzle passage by-passes the control valve assembly so that air may be purged from the system when the pump initially is started. An air purging valve within the second outlet passage is movable between closed and open positions for blocking fuel flow through such passage during normal operation of the pump and for opening the second passage when the pump initially is started. In one form of the invention, the purging valve is operable manually and, in another form of the invention, the air purging valve operates automatically.

15 Claims, 4 Drawing Figures

OIL BURNER PUMPING SYSTEM WITH AIR PURGING VALVE

BACKGROUND OF THE INVENTION

The present invention relates generally to a fuel burner pumping system having means for purging air from the system. More particularly, the invention relates to a system in which such means includes an air purging valve located within an outlet passage leading from a fuel pump to a nozzle passage so as to by-pass a fuel pressure control valve so that air from the system is exhausted directly into the nozzle passage.

In one prior system of the foregoing type, fuel from a supply is drawn through a line by a crescent gear pump and is fed under pressure into the main chamber of a pressure control valve through an outlet passage communicating between the pump and the chamber. From the main chamber, the pressurized fuel flows through an outlet port into a passage communicating with a burner nozzle or nozzles. An air purging valve is disposed within a second outlet passage by-passing the main chamber outlet port so as to communicate directly with the nozzle passage. In this prior system, the air purging valve is spring-biased toward a closed position to shut off fuel flow through the second outlet passage when the pump is inoperative and the fuel pressure within the system is lower than the air pressure capable of being generated by the pump. To purge air from the system as the pump is started, the valve opens after the fluid pressure in the system becomes sufficient to overcome the biasing force of the spring. The purging valve remains open as long as the fluid pressure within the system is sufficient to overcome the spring. Accordingly, during normal operation of the pump, fluid flows into the nozzle passage through both the outlet port of the main chamber and the second outlet passage.

Oil burner pumping sytems of the foregoing broad general character are disclosed in U.S. Pat. Nos. 3,566,901; 3,446,232; 3,446,231; and 3,446,230. Other systems having air purging means are disclosed in U.S. Pat. Nos. 3,273,513; 3,143,967; 2,931,314; 2,915,015; and 2,763,336.

SUMMARY OF THE INVENTION

The primary object of the present invention is to provide a new and improved fuel burner pumping system of the foregoing general character in which the valve for purging air from the system outwardly through the nozzle passage remains normally closed during the regular operation of the pump but still may be opened with the pump initially is turned on for purging air from the system.

A more detailed object is to achieve the foregoing in one embodiment by constructing the air purging valve to be operable manually from outside a housing member of the pump for movement from a normally closed position blocking the flow of fluid through the second outlet passage to an open position permitting air to flow through the second outlet passage and into the nozzle passage.

The invention also resides in the provision of an air purging valve of the type which remains closed during normal operation of a burner system in a system of the type employing a shut-off valve which closes to block the flow of fuel through the nozzle at the same time that the pump is shut off.

A further object is to construct a system of this latter type so that the air purging valve opens automatically for air to be purged from the system when the pump initially is turned on, the air purging valve thereafter closing automatically once the system is purged of air. A still further object is to provide in such a system an automatic air purging valve which closes as the fuel pressure acting against the pressure control valve approaches a magnitude sufficient to begin opening of the control valve.

These and other objects and advantages of the present invention will become more apparent from the following detailed description when taken in conjunction with the accompanying drawings.

DETAILED DESCRIPTION OF THE PREFERRED EMBODIMENTS

Figures 1, 2:
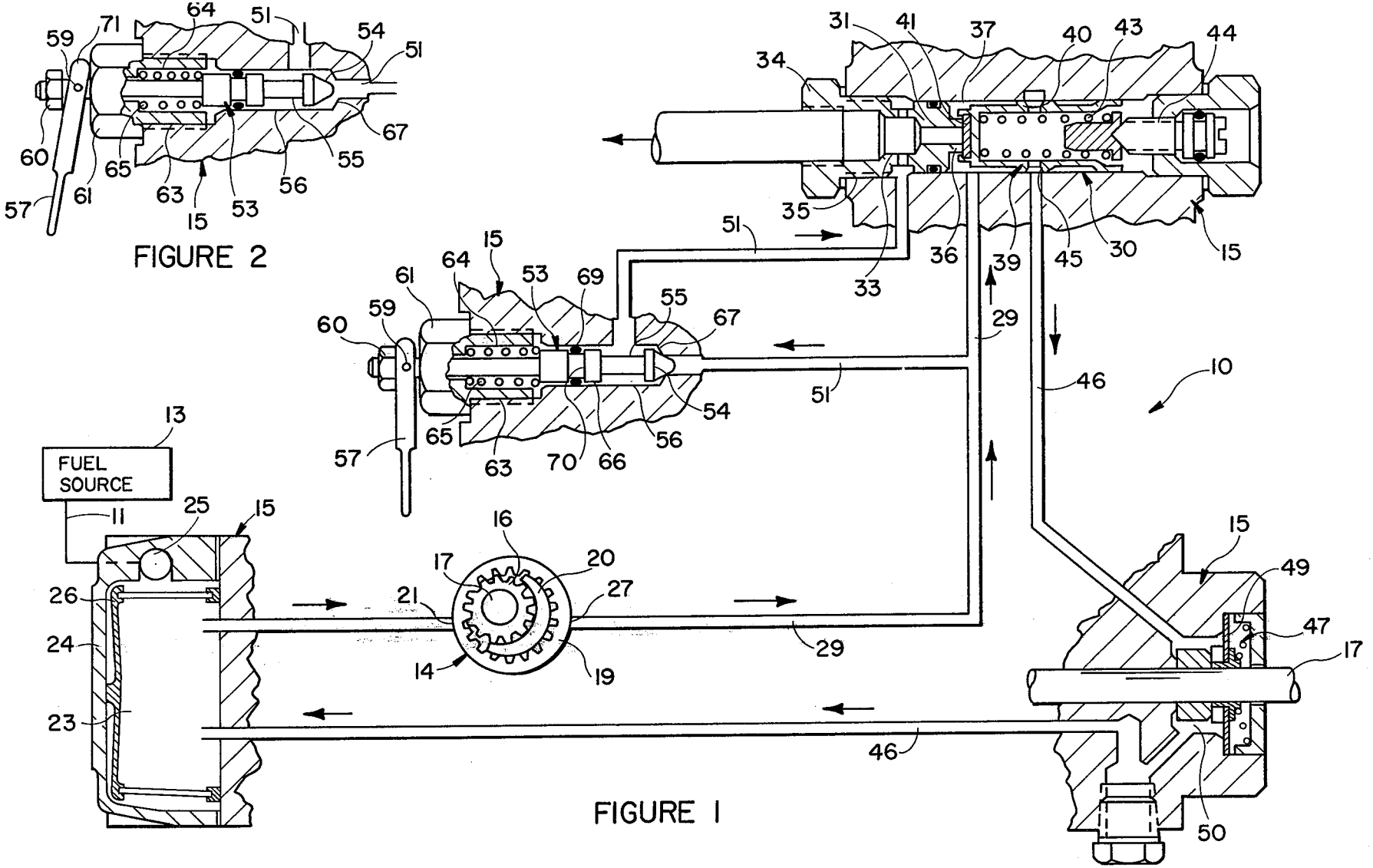
FIG. 1 is a schematic illustration of a fuel burner pumping system embodying the novel features of the present invention.
FIG. 2 is a view of a portion of the system showing parts thereof in moved positions.

As shown in the drawings for purposes of illustration, the present invention is embodied in a fuel burner pumping system 10 of the type used in supplying fuel oil to a heating unit (not shown) such as a furnace or boiler. Herein, the system is disclosed as used in a so-called one-pipe lift installation wherein fuel is fed through a single line 11 leading from a suitable source 13 to a fuel pump 14. It will be appreciated, however, that with minor modifications, the present system also may be employed in other types of installations.

With reference to FIG. 1, the fuel pump 14 is mounted within a housing 15 and is of the crescent gear type including an inner gear 16 mounted on a drive shaft 17 and eccentrically disposed with respect to an inter-meshing outer gear 19. A crescent-shaped member 20 is disposed within the non-engaging portions of the teeth on the gears for the purpose of sealing the expanding fluid chambers defined by the gears from the contracting fluid chambers in well-known fashion. An inlet 21 of the pump communicates through the housing with a reservoir 23. The latter is defined by an end cover 24 bolted to the housing and having an intake 25 to which the fuel line 11 is connected. A suitable strainer 26 located within the reservoir between the intake and the pump inlet serves to filter the fuel as it is drawn from the supply into the pump. Upon exiting the pump, the fuel flows though an outlet 27 into an outlet passage 29 communicating with a control valve assembly 30 which serves to regulate the pressure of the fuel flowing to a burner nozzle or nozzles (not shown) so as to be substantially constant.

Herein, the control valve assembly 30 is located within the housing 15 and serves to control the pressure of fuel through an outlet port 31 communicating with a nozzle passage 33 which leads to the fuel burner nozzle or nozzles. The outlet port is defined by a fitting 34 threaded into a bore 35 in one end of the housing and the fitting has a projection 36 defining a valve seat adapted to be closed by the control valve 30.

More particularly, the control valve assembly includes a main pressure chamber 37 communicating with the pump outlet passage 29. A hollow valve member 39 is slidably mounted within the main pressure chamber and includes a land 40 disposed centrally between opposite ends of the valve member. Affixed within an undercut recess in the forward end of the valve member is a valve closure 41 adapted to engage the valve seat 36 and close the outlet port 31.

In operation, high pressure fuel entering the main pressure chamber 31 from the pump 14 moves the valve member 39 to the right against the closing force of a coil compression spring 43 seated within the hollow portion of the valve member and reacting against a normally stationary, but adjustable spring seat 44. When the pressure in the chamber is sufficient to overcome the closing force of the spring, the valve member will move to the right, opening the outlet port and permitting fuel to flow into the nozzle passage 33. Only a portion of the fuel from the outlet passage 29 of the pump exits the control valve 30 through the outlet port 31, the remaining portion by-passes the outlet port and exits the main pressure chamber through a return port 45 opening into a return passage 46 leading back to the reservoir 23. In normal operation, the fuel flow from the pump 14 is sufficient to move the valve member 39 to the right far enough for the land 40 to uncover the return port 45 so fuel continuously passes into the return passage while the valve member, in conjunction with the spring 43, modulates a constant pressure fuel flow through the outlet port 31 into the nozzle passage 33.

As shown in FIG. 1, the return passage 46 communicates with a shaft seal assembly 47 located within the housing and serving to keep fuel from leaking along the drive shaft 17 and out of the housing 15. In particular, the seal assembly includes a sealing member 49 engaging the drive shaft between the outside of the housing and a collection chamber 50 within which fuel flowing along the shaft accumulates and is kept from flowing out of the housing. From the collection chamber, the passage 46 leads back to the reservoir 23 returning both the excess fuel from the main pressure chamber 30 and the leakage fuel from along the shaft. In other types of installations, the return passage may connect directly with the fuel supply source 13.

In the exemplary fuel pumping system 10, in order to purge air from the pump 14 as the latter initially is started, a second outlet passage 51 is located between the pump and the nozzle passage 33 to by-pass the control valve assembly 30 for exhausting air and mixed fuel and air into the nozzle passage instead of having to drain and collect this mixture in a special container. As the pump is started, an air purging valve 53 in this outlet passage may be opened so that air trapped within the pump may be exhausted from the system without creating a mess outside of the heating unit.

The present invention contemplates an improved fuel pumping system 10 in which the air purging valve 53 remains closed during normal operation of the pump 14 so as to keep fuel from flowing through the second outlet passage 51 and into the nozzle passage 33 after the system is purged of air. For this purpose, valve means defining the air purging valve 53 are constructed in a novel fashion and include a movable valve body 54 normally held in a closed position to block the flow of fuel through the second outlet passage. But, when the pump initially is started, the valve body may be moved into an open position permitting air to be purged from the system, the fuel flowing through the second outlet passage and into the nozzle passage. Once air is purged from the system, the valve is closed and remains closed throughout the normal operation of the pump. By virtue of this arrangement, high pressure fuel is kept from flowing through the second outlet passage and into the nozzle passage during normal operation of the pump so as to avoid interfering with the regulated flow of fuel entering the nozzle passage from the outlet port 31 of the main pressure chamber 37.

In one form of the present invention (shown in FIGS. 1 and 2), the air purging valve means 53 is in the form of a manually operable valve including the valve body 54 with means connected thereto for moving the valve body between open and closed positions within the second outlet passage 51. Herein, such connecting means is in the form of an elongated stem 55 integrally connected to the valve body and extending outwardly through a bore 56 formed in the housing 15 for connection with a handle 57. The handle is pivotally connected to the outer end portion of the stem by a pin 59 between a nut 60 threaded on the outer end of the stem and a fitting 61 threaded into a counter bore 63 formed in the housing. A recess 64 in the inner end of the fitting receives a spring 65 telescoped on to the stem between the bottom of the recess and a shoulder 66 formed intermediate the ends of the stem. The spring is of sufficient strength to urge the valve stem inwardly so the valve body 54 is held against a suitable seat 67 to block the flow of fuel through the second oulet passage under the high fuel pressures generated by normal operation of the pump 14. To keep fuel from leaking along the stem and out of the housing, an O-ring seal 69 seated within an annular groove 70 formed in the shoulder engages the sides of the bore 56.

In the foregoing described embodiment of the exemplary pumping system 10, to purge air from the system when the pump 14 is started, the handle 57 is pulled outwardly (see FIG. 2) with one end 71 of the handle levering against the fitting 61 so the stem 55 is pulled outwardly by the pin 59. The stem, in turn, pulls the valve body 54 away from its seat 57, thereby opening the second outlet passage 51 to permit air to flow through such passage and into the nozzle passage 33. Thus, the air trapped in the pump may be easily vented from the system. Once the air is vented from the system, the handle is simply released to allow the spring 65 to urge the valve body back against the seat to close off the second outlet passage.

Figure 3:
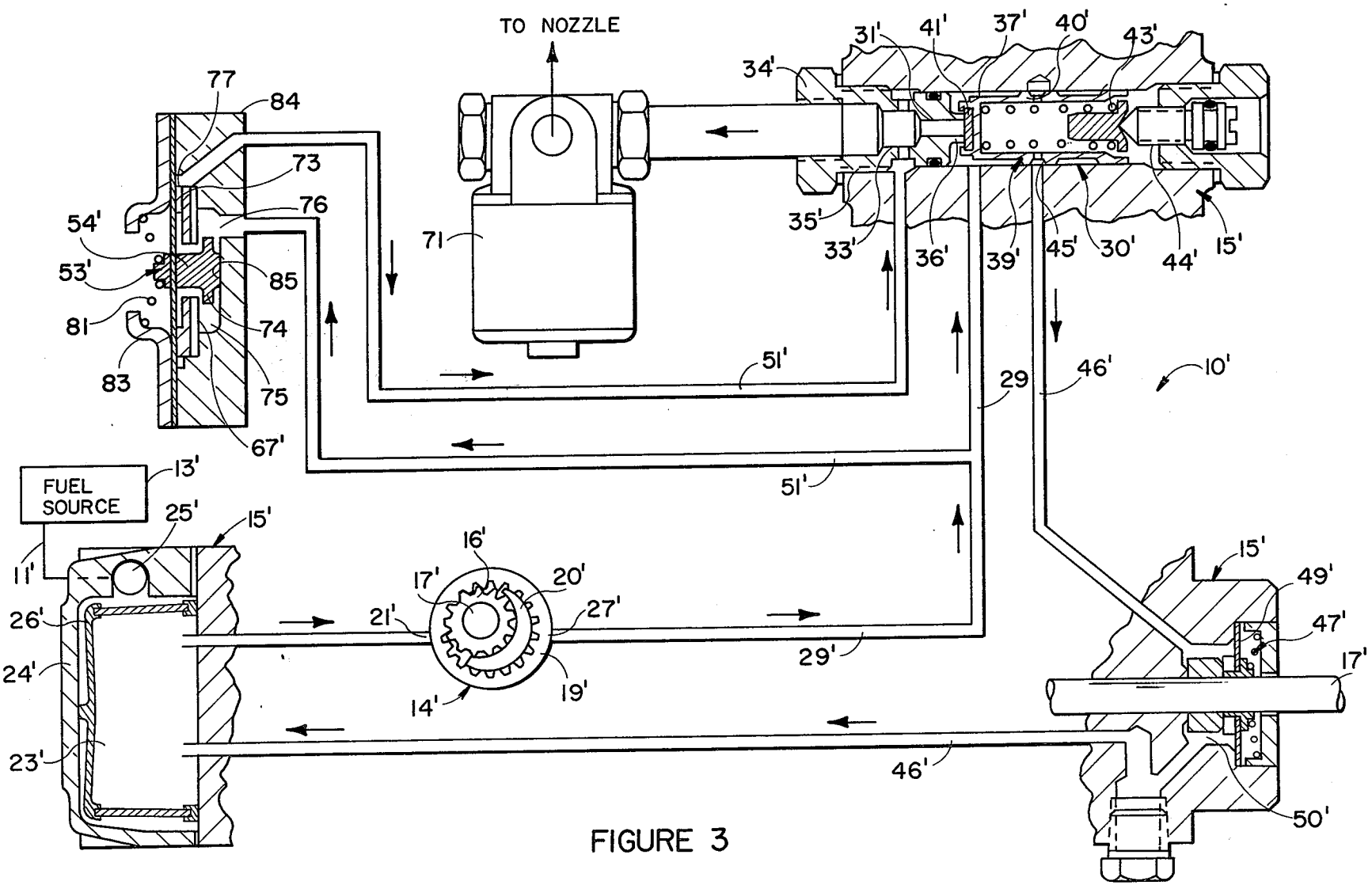
FIG. 3 is a schematic illustration of an alternative embodiment of the present invention.
Figure 4:
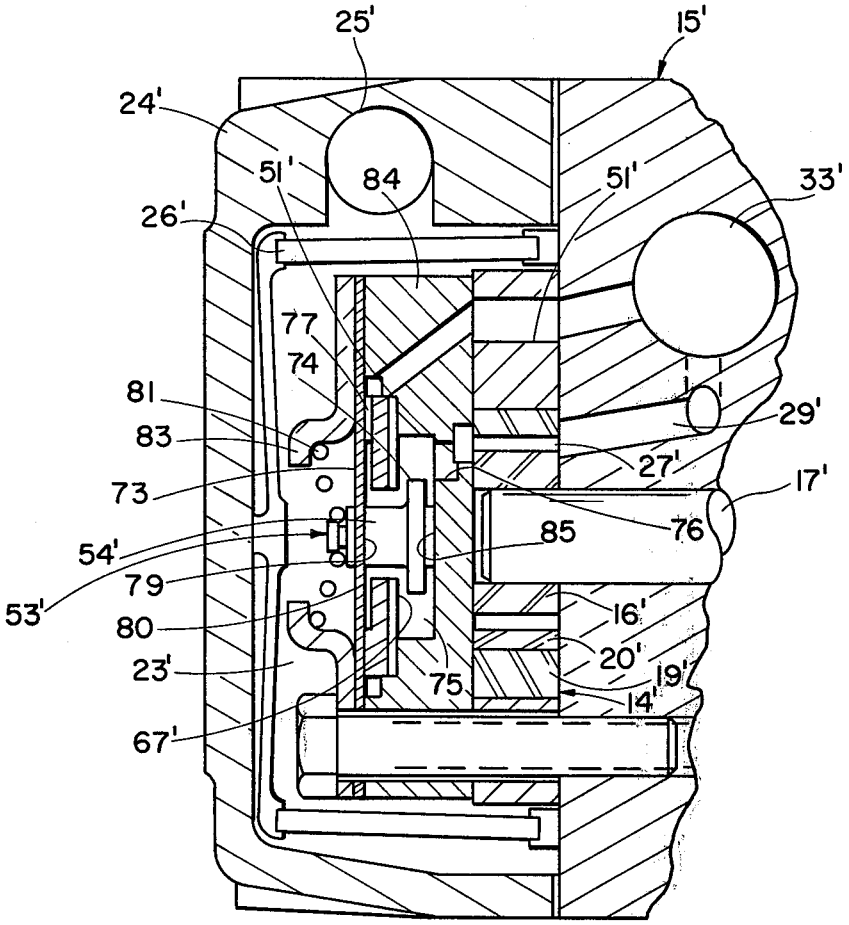
FIG. 4 is an enlarged cross-sectional view of a portion of the system shown in FIG. 3.

A second form of the present invention is shown in FIGS. 3 and 4, wherein parts corresponding to those described in the first embodiment ar identified by the same but primed reference numbers. In the second form of the fuel pumping system 10′, a suitable shut-off valve means 71, such a conventional solenoid valve, is located within the nozzle passage 33′ between the burner nozzle and the opening of the second outlet passage 51′ into the nozzle passage. Preferably, the shut-off valve is operable in conjunction with a thermostate (not shown) controlling operation of the pump 14′ so that, as the pump is turned on and off, the shut-off valve is opened and closed to control the flow of fuel to the nozzle. With such a valve in the system, when the pump is turned on, the shut-off valve is opened, permitting fuel flow to the nozzle, but, at the same time the pump is turned off, the valve closes, blocking fuel flow to the burner nozzle.

Advantageously, in this latter form of the exemplary pumping system, the air purging valve means 53' is operable automatically to purge the system of air as the pump 14' is started, while still serving to block the flow of fuel through the second outlet passage 51' as the magnitude of the fuel pressure in the system builds toward normalvalues. As shown in FIG. 4, the automatic air purging valve is bolted to the housing 15' along with the crescent gear pump 14' and is located within the reservoir 23'. More particularly, the valve body 54' is in the form of a generally cylindrical plunger which is connected to fluid pressure responsive means for urging the body into its closed position as the output fluid pressure from the pump approaches a magnitude to begin opening the control valve 30'. Preferably, the fluid pressure responsive means is in the form of a flexible diaphragm 73. The plunger includes an annular flange 74 sized to engage the valve seat 67'. Herein, the plunger is located within an operating chamber 75 having inlet and outlet ports 76 and 77 communicating with the second outlet passage 51' so that fuel pumped through the outlet passage necessarily flows through the operating chamber. The diaphragm extends across the outer end of the operating chamber and includes inner an outer faces 79 and 80 communicating directly with the operating chamber and the reservoir, respectively. Urging the plunger and the diaphragm inwardly is a spring 81 having an inner end connected to the outer end of the plunger and an outer end seated against an outwardly extending projection of a cap plate 83. The latter is secured to a block member 84 within which is formed the operating chamber 75, the diaphragm being sandwiched between the plate and the block member.

Preferably, the strength of the spring 81 is such as to move the plunger 54' inwardly until the inner end of the plunger engages the inner wall 85 of the operating chamber (see FIG. 4) when the magnitude of the fuel pressure within the operating chamber is less than approximately 25 percent of the normal operating pressure of the system, thereby opening the purging valve 53' to allow air to be exhausted from the system through the second outlet passage 51' and nozzle passage 33'. Advantageously, this means that every time the pump is started, when the system pressure has dropped below 25 percent of the normal operating fuel pressure, any air in the system is exhausted automatically through the second outlet passage and into the nozzle passage. As the pump 14' begins to build up fluid pressure in excess of the valve opening pressure, the fluid pressure in the operating chamber 75 pushes the diaphragm 73 outwardly, thereby pulling the plunger 54' away from the inner wall of the chamber and closing the flage 74 against the valve seat 67' to block the flow of fluid through the operating chamber. By virtue of operating in this fashion, it will be appreciated that the air purging valve remains closed during normal operation of the pump to keep fuel from flowing into the nozzle passage from the second outlet passage and interfering with the regulated flow of fuel from the main pressure chamber 37'.

Thus, it is seen from the foregoing that the present invention brings to the art a new and improved pumping system 10 wherein fuel is kept from by-passing the control valve assembly 30 during normal operation of the pump 14 while still enabling air to be purged easily from the system when the pump is started. In one form of the invention, this is accomplished through the provision of the unique, manually-operated air purging valve 53, which is spring urged into a closed position to block fuel flow through the second outlet passage 51 during normal operation of the pump, but is movable manually into an open position when it is desired to purge air from the system. In another form of the invention, an automatic air purging valve 53' serves to purge air from the system initially as the pump 14' is started, but as the pressure in the system begins to approach normal operating magnitudes, the valve is closed and remains closed during normal operation of the pump.

We claim:

1. A fuel burner pumping system including a fuel pump having an inlet and an outlet, a control valve assembly including a main pressure chamber, an outlet port, a valve member movable within said chamber to open and close said port, and means for urging said valve member toward its closed position, a first outlet passage communicating between said pump outlet and said main chamber to supply pressurized fuel from said pump to said chamber, a nozzle passage communicating with said main chamber through said outlet port, a second outlet passage communicating between the pump outlet and said nozzle passage, valve means disposed within said second outlet passage and being movable between closed and open positions for blocking the flow of fuel through said second outlet passage normal operation of said pump and for opening said second passage to purge air from said system when said pump initially is started and means for urging said valve means toward one of said positions.

2. A fuel burner pumping system as defined by claim 1 including a housing containing said pump, said valve means including a valve body disposed within said second outlet passage for movement between said open and closed positions and means connected to said body and extending outside of said housing for moving said body manually from its closed position to its open position.

3. A fuel burner pumping system as defined by claim 2 wherein said second outlet passage is disposed within said housing, said means connected to said body including a stem attached to said body and extending outwardly therefrom through said housing, a handle attached to said stem outside of said housing for moving said body between its open and closed position.

4. A fuel burner pumping system as defined by claim 3 wherein said means for urging includes a spring connected with said stem within said housing and acting between said valve body and said housing to urge said valve body normally toward its closed position.

5. A fuel burner pumping system as defined by claim 4 wherein said handle includes opposite ends and is connected pivotally with said intermediate the ends thereof for levering said handle against said housing to pull said stem outwardly and thereby move said valve body into its open position.

6. A fuel burner pumping system as defined by claim 5 including a seal formed between said housing and said stem to keep fuel from leaking out of said housing around said stem.

7. A fuel burner pumping system as defined by claim 1 wherein said valve means includes a valve body disposed within said second outlet passage for movement between said open and closed positions, fluid pressure responsive means connected to said body for urging said body into its closed position automatically as the output fluid pressure from said pump approaches a magnitude for opening said control valve, means for acting against said body to urge said valve body into its open position automatically when the output fluid pressure from said pump is substantially lower than said magnitude, thereby enabling air to flow through said second outlet passage and into said nozzle passage.

8. A fuel burner pumping system as defined by claim 7 including shut-off valve means located downstream of the opening of said second outlet passage into said nozzle passage for blocking the flow of fuel through said nozzle passage when said pump is shut off and for permitting the flow of fuel through said nozzle passage when said pump is operating.

9. A fuel burner pumping system including a fuel pump having an inlet and an outlet, a control valve assembly including a main pressure chamber, an outlet port, a valve member movable within said chamber to open and close said port, and means for urging said valve member toward its closed position, a first outlet passage communicating between said pump outlet and said main chamber to supply pressurized fuel from said pump to said chamber, a nozzle passage communicating with said main chamber through and outlet port, a second outlet passage communicating between said pump outlet and said nozzle passage, and valve means disposed within said second outlet passage and being movable between closed and open positions for blocking the flow of fuel through said second outlet passage during normal operation of said pump and for opening said second passage to purge air from said system when said pump initially is started, said valve means including valve body disposed within said second outlet passage for movement between said open and closed positions, fluid pressure responsive means connected to said body for urging said body into its closed position automatically as the output fluid pressure from said pump approaches a magnitude for opening said control valve, means for urging said body into its open position automatically when the output fluid pressure from said pump is substantially lower than said magnitude, thereby enabling air to flow through said second outlet passage and into said nozzle passage, shutoff valve means located downstream of the opening of said second outlet passage into said nozzle passage for blocking the flow of fuel through said nozzle passage when said pump is shut off and for permitting the flow of fuel through said nozzle passage when said pump is operating, and an inlet reservoir connected between said fuel line and said pump inlet for receiving low pressure before entering said pump inlet, said fuel pressure responsive means including a movable member connected to said valve body to move said valve body into its open position, said member being mounted between said reservoir and said second outlet passage and having first and second faces communicating with said reservoir and said second outlet passage, respectively.

10. A fuel burner pumping system as defined by claim 9 including a spring acting against said member and urging the latter to move said valve body toward its open position.

11. A fuel burner pumping system as defined by claim 10 wherein said member comprises a flexible diaphragm sealed between said reservoir and said second outlet passage with one side of said diaphragm defining said first face and the other side of said diaphragm defining said second face, said valve body being secured to said diaphragm for movement therewith between its open and closed positions in response to fluid pressure difference sensed by said diaphragm between said reservoir and said second outlet passage.

12. A fuel burner pumping system including a fuel pump having an inlet and an outlet, a source for supplying fuel under low pressure to said pump, a fuel line communicating between said source and said pump inlet, a control valve assembly including a main pressure chamber, an outlet port, a valve member movable within said chamber to open and close said port and means for urging said valve member toward its closed position to regulate the pressure of the fuel flowing through said outlet port, a first outlet passage from said pump communicating with said main chamber for said pump to supply fuel under high pressure to said chamber, a nozzle passage communicating with said main chamber through said outlet port, and means for manually purging air from said pump through said nozzle passage, said manual purging means including a second outlet passage communicating between said pump and said nozzle passage, valve means disposed within said second outlet passage and being manually operable from a normally closed position blocking fluid flow through said second outlet passage to an open position for air to flow through said second outlet passage and into said nozzle passage to purge air from said pumping system, and means for urging said valve means toward its closed position.

13. A fuel burner pumping system including, a housing, a fuel pump disposed within said housing and having an inlet and an outlet, a source for supplying fuel under low pressure to said pump, a fuel line communicating between said source and said pump inlet, a control valve assembly including a main pressure chamber, an outlet port, a valve member movable within said chamber to open and close said port and means for urging said valve member toward its closed position to regulate the pressure of the fuel passing through said outlet port, a first outlet passage from said pump communicating with said main chamber for said pump to supply fuel under high pressure to said chamber, a nozzle passage communicating with said main chamber through said outlet port, and means for manually purging air from said pump through said nozzle passage, said manual purging means including a second outlet passage communicating between said pump and said nozzle passage, a valve body disposed within said second outlet passage for movement between a normally closed position blocking fluid flow through said second outlet passage and into said nozzle passage, means for urging said valve body toward its closed position, a stem attached to said valve body and extending outwardly therefrom through said housing, and a handle attached to said stem outside of said housing for moving said valve body manually from its closed position into its open position.

14. A fuel burner pumping system including, a fuel pump having an inlet and an outlet, a source for supplying fuel under low pressure to said pump, a fuel line communicating between said source and said pump inlet, a control valve assembly including a main pressure chamber, an outlet port, a valve member movable within said chamber to open and close said port, and means for urging said valve member toward its closed position to regulate the pressure of the fuel passing through said outlet port, a first outlet passage communicating between said pump outlet and said main chamber for said pump to supply fuel under high pressure to said chamber, a nozle passage communicating with said main chamber through said outlet port, a second outlet passage communicating between said pump outlet and said nozzle passage, and valve means disposed within said second outlet passage and being movable between closed and open positions for blocking the flow of fuel through said second outlet passage during normal operation of said pump and for opening said second outlet passage automatically to purge air from said system when said pump initially is started.

15. A fuel burner pumping system including a fuel pump having an inlet and an outlet, a source for supplying fuel under low pressure to said pump, a fuel line communicating between said source and said pump inlet, a control valve assembly including a main pressure chamber, an outlet port, a valve member movable within said chamber to open and close said port, and means for urging said valve member toward its closed position to regulate the pressure of the fuel passing through said outlet ports, a first outlet passage communicating between said pump outlet and said main chamber for said pump to supply fuel under high pressure to said chamber, a nozzle passage communicating with said main chamber through said outlet port, shut-off valve means located within said nozzle passage downstream of said outlet port for blocking the flow of fuel through said nozzle passage when said pump is shut off and for permitting the flow of fuel through said nozzle passage when said pump is operating, a second outlet passage from said pump communicating with said nozzle passage between said shut-off valve means and said outlet port, a valve body disposed within said second outlet passage for movement between a closed position blocking the flow of fuel through said second outlet passage and an open position permitting air to be purged from said pump into said nozzle passage, pressure responsive means connected to said valve body for urging said body into its closed position automatically as the output fluid pressure from said pump approaches a magnitude for opening said control valve, and spring means for urging said body into its open position automatically when the output fluid pressure from said pump is substantially lower than said magnitude, so as to enable air to flow through said second outlet passage and into said nozzle passage.

* * * * *